US010097917B2

(12) United States Patent
Button et al.

(10) Patent No.: US 10,097,917 B2
(45) Date of Patent: Oct. 9, 2018

(54) SYSTEM FOR REDUCING RESPONSE ANOMALIES IN AN ACOUSTIC PATHWAY

(71) Applicant: HARMAN INTERNATIONAL INDUSTRIES, INC., Stamford, CT (US)

(72) Inventors: Douglas J. Button, Simi Valley, CA (US); Jerry Moro, Moorpark, CA (US)

(73) Assignee: Harman International Industries, Incorporated, Stamford, CT (US)

( * ) Notice: Subject to any disclaimer, the term of this patent is extended or adjusted under 35 U.S.C. 154(b) by 72 days.

(21) Appl. No.: 15/298,997

(22) Filed: Oct. 20, 2016

(65) Prior Publication Data

US 2018/0115823 A1 Apr. 26, 2018

(51) Int. Cl.

| | |
|---|---|
| ***H04R 1/34*** | (2006.01) |
| ***H04R 3/04*** | (2006.01) |
| ***H04R 1/30*** | (2006.01) |
| *H04R 1/32* | (2006.01) |
| *H04R 1/28* | (2006.01) |
| *H04R 3/08* | (2006.01) |

(52) U.S. Cl.

CPC ..... *H04R 1/345* (2013.01); *H04R 1/30* (2013.01); *H04R 3/04* (2013.01); *H04R 1/2865* (2013.01); *H04R 1/323* (2013.01); *H04R 3/08* (2013.01); *H04R 2400/13* (2013.01)

(58) Field of Classification Search

CPC ..... H04R 1/30; H04R 1/323; H04R 1/345; H04R 1/2865; H04R 3/04; H04R 3/08; H04R 2400/13

See application file for complete search history.

(56) References Cited

U.S. PATENT DOCUMENTS

| | | | | |
|---|---|---|---|---|
| 1,996,743 A * | 4/1935 | Blattner | ..... | G10K 11/025 181/195 |
| 8,121,312 B2 | 2/2012 | Horbach et al. | | |
| 8,160,268 B2 | 4/2012 | Horbach | | |
| 8,170,233 B2 | 5/2012 | Horbach | | |

(Continued)

OTHER PUBLICATIONS

Radiomuseum; "Horn Loudspeaker 32A," Sep. 22, 2014; http://www.radiomuseum.org/r/western_el_horn_loudspeaker_32a.html.

(Continued)

*Primary Examiner* — Joshua Kaufman
(74) *Attorney, Agent, or Firm* — Brooks Kushman P.C.

(57) ABSTRACT

An acoustic system that includes an acoustic assembly and a sound system. The acoustic assembly at least includes a tube removably attached to a compression driver. Additionally, the acoustic assembly includes either a waveguide or a deflector. Either the waveguide or the deflector is also removably attached to the tube. The sound system communicates with the acoustic assembly and includes a filter. The filter includes a filter length that is based on an impulse response of the acoustic assembly. As part of the communication, the sound system sends an audio signal, which has been filtered by the filter, to the acoustic assembly. In response to the audio signal, the compression driver generates a sound wave that travels through the acoustic assembly. While traveling, the acoustic assembly transitions the sound wave from generally traveling in a first direction to a second direction.

27 Claims, 7 Drawing Sheets

(56) References Cited

U.S. PATENT DOCUMENTS

| | | | | |
|---|---|---|---|---|
| 2009/0225996 | A1* | 9/2009 | Brooking | H04R 3/04 381/59 |
| 2014/0185854 | A1* | 7/2014 | Murphy | H04R 1/26 381/343 |
| 2015/0249889 | A1* | 9/2015 | Iyer | H04R 3/08 381/98 |

OTHER PUBLICATIONS

UBL/Harman International; "Professional Series, Radial Horns"; Apr. 1981 (4 pages).
Worthpoint; "Western Electric VNTG.Horn 32A & Receiver Driver 720A;" Sep. 22, 2014; http://www.worthpoint.com/worthopedia/wester-electri-vntg-horn-32a-88005422.

* cited by examiner

SYSTEM FOR REDUCING RESPONSE ANOMALIES IN AN ACOUSTIC PATHWAY

TECHNICAL FIELD

Embodiments disclosed herein generally relate to an acoustic system, which includes an acoustic assembly and a sound system therefor, for reducing response anomalies in an acoustic pathway of the acoustic assembly.

BACKGROUND

In a conventionally arranged acoustic assembly, a compression driver attaches directly to a waveguide. The compression driver and the waveguide align along a single, common axis. During operation, the compression driver generates a sound wave that generally travels along the single, common axis. The single, common axis, however, may be problematic in a number of applications. For example, in a shallow-depth environment, a shallow distance separates a first surface from a second surface. Often, in the shallow-depth environment, the single, common axis runs perpendicular to the first surface and the second surface. In such a situation, the conventionally arranged acoustic assembly faces a significant dimensional constraint—i.e., the shallow distance. Because of that, when designing the conventionally arranged acoustic assembly, the critical focus often is on the dimensional constraint, as opposed to acoustics. Therefore, in certain applications, the single, common axis may result in sacrificing acoustic quality.

SUMMARY

One embodiment provides an acoustic system. The acoustic system includes an acoustic assembly and a sound system. The acoustic assembly includes a waveguide that is aligned along a first axis. The waveguide is removably attached to a tube. The tube is removably attached to a compression driver. The compression driver is aligned along a second axis. The sound system includes, among other items, a finite impulse response (FIR) filter. The FIR filter includes a filter length that is based on an impulse response of the acoustic assembly. The sound system sends an audio signal, which has been filtered by the FIR filter, to the acoustic assembly. In response to the audio signal, the acoustic assembly generates a sound wave that travels through and eventually out of the acoustic assembly. While traveling, the sound wave transitions from a first direction, which is generally along the second axis, to a second direction, which is generally along the first axis.

Another embodiment provides an acoustic system. The acoustic system includes an acoustic assembly and a sound system. The acoustic assembly includes a waveguide. The waveguide includes a throat that is aligned along a first axis. The throat is removably attached to a first end of a tube. A second end of the tube is removably attached to an output opening of a compression driver. The output opening is aligned along a second axis. The sound system, among other items, includes a FIR filter. The FIR filter includes a filter length that is based on an impulse response of the acoustic assembly. The sound system sends an audio signal, which has been filtered by the FIR filter, to the compression driver. In response to the audio signal, the compression driver generates a sound wave that travels through and eventually out of the acoustic assembly. While traveling, the sound wave transitions from a first direction, which is generally along the second axis, to a second direction, which is generally along the first axis.

Another embodiment provides an acoustic system. The acoustic system includes an acoustic assembly and a sound system. The acoustic system includes a tube that is removably attached to a compression driver. Additionally, either a waveguide or a deflector is also attached to the tube. The sound system, among other items, includes a FIR filter. The FIR filter includes a filter length that is based on an impulse response of the acoustic assembly. The sound system sends an audio signal, which has been filtered by the FIR filter, to the compression driver. In response to the audio signal, the compression driver generates a sound wave that travels through and eventually out of the acoustic assembly. While traveling, the sound wave transitions from a first direction to a second direction.

Another embodiment provides an acoustic system. The acoustic system includes an acoustic assembly and a sound system. The acoustic assembly and the sound system are in communication. The sound system, among other items, includes a FIR filter. In the sound system, the FIR filter receives a digital signal. The FIR filter filters the digital signal according to a filter length. The filter length is based on an impulse response of the acoustic assembly. The impulse response includes a direct portion and a post-direct portion. The filter length is set such that at least a portion of the post-direct portion has a flat response. A digital to audio converter (DAC) converts the filtered digital signal from the FIR filter to an analog signal. An amplifier amplifies the analog signal from the DAC. The sound system sends the amplified analog signal from the amplifier to the acoustic assembly. In response to the amplified analog signal, the acoustic assembly generates a sound wave to travel through the acoustic assembly. While traveling, the sound wave transitions from a first direction to a second direction.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

The embodiments of the present disclosure generally provide for a plurality of circuits or other electrical devices. All references to the circuits and other electrical devices and the functionality provided by each are not intended to be limited to encompassing only what is illustrated and described herein. While particular labels may be assigned to the various circuits or other electrical devices disclosed, such labels are not intended to limit the scope of operation for the circuits and the other electrical devices. Such circuits and other electrical devices may be combined with each other and/or separated in any manner based on the particular type of electrical implementation desired. It is recognized that any circuit or other electrical device disclosed herein may include any number of microcontrollers, processors, integrated circuits, memory devices (e.g., FLASH, random access memory (RAM), read only memory (ROM), electrically programmable read only memory (EPROM), electrically erasable programmable read only memory (EEPROM), or other suitable variants thereof) and software which co-act with one another to perform any operation(s) disclosed herein. In addition, any one or more of the electrical devices may be configured to execute a computer-program that is embodied in a non-transitory computer readable medium that is programmed to perform any number of the functions as disclosed.

Figure 1:
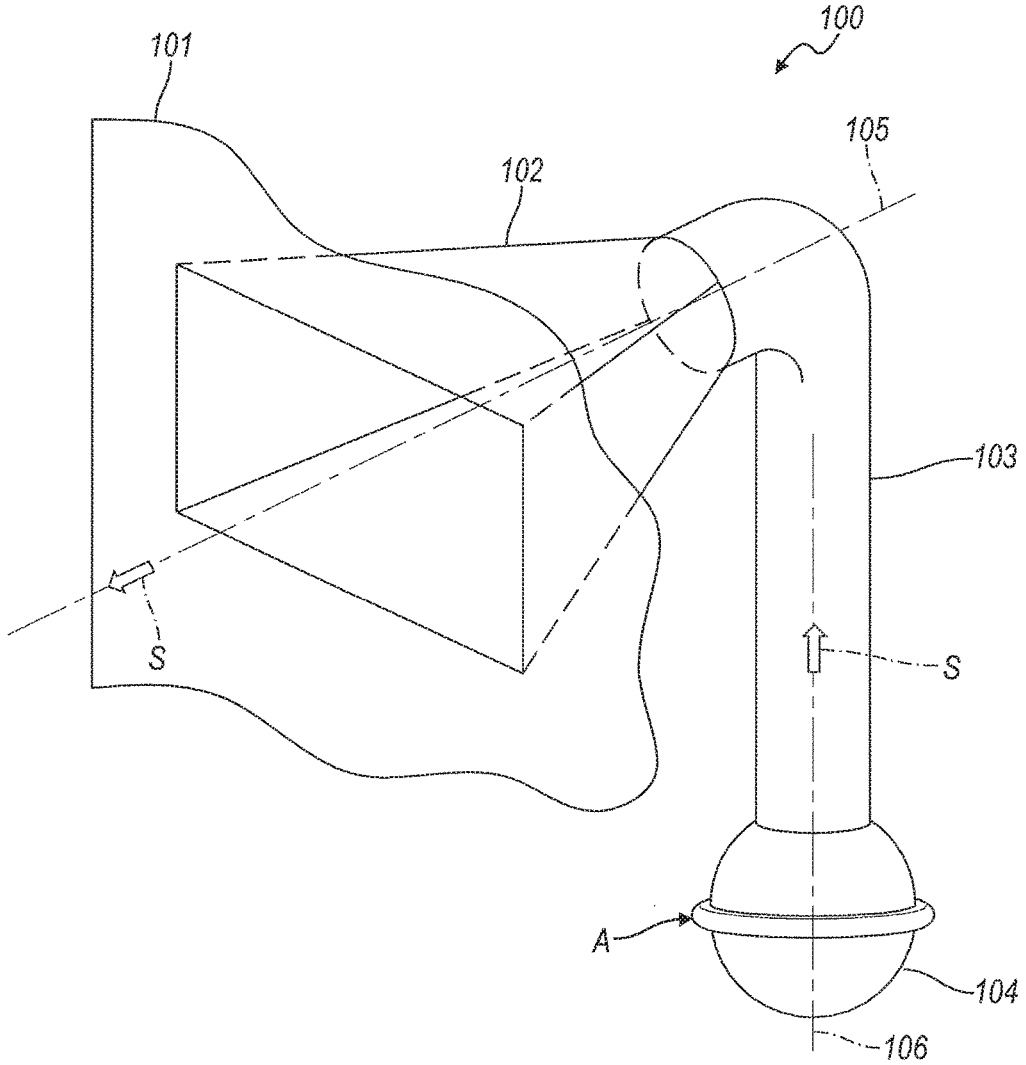
FIG. 1 is a front perspective view of an acoustic assembly, which is in accordance with one or more embodiments.

In accordance with one or more embodiments, FIG. 1 illustrates a perspective view of an acoustic assembly 100 in an angled orientation and mounted to a first surface 101. The acoustic assembly 100 includes a waveguide 102. The waveguide 102 mounts to the first surface 101 and removably attaches to a tube 103. The tube 103 removably attaches to a compression driver 104.

In the angled orientation, the waveguide 102 aligns along a first axis 105, and the compression driver 104 aligns along a second axis 106. During operation, the compression driver 104 receives an audio signal A. In response to the audio signal A, the compression driver 104 generates a sound wave S. In general, the sound wave S travels from the compression driver 104, through the tube 103, and out the waveguide 102.

From the compression driver 104, the sound wave S generally travels in a first direction along or parallel to the second axis 106. When entering the waveguide 102, the sound wave S has generally transitioned to a second direction, which is along or parallel to the first axis 105. The change from the first direction to the second direction is due to the angled orientation. From the second direction, the shape of the waveguide 102 influences the travel direction of the sound wave S. More specifically, the shape of the waveguide 102 directs the sound wave S to cover a particular pattern, such as by further influencing the direction of travel.

Figure 2A:
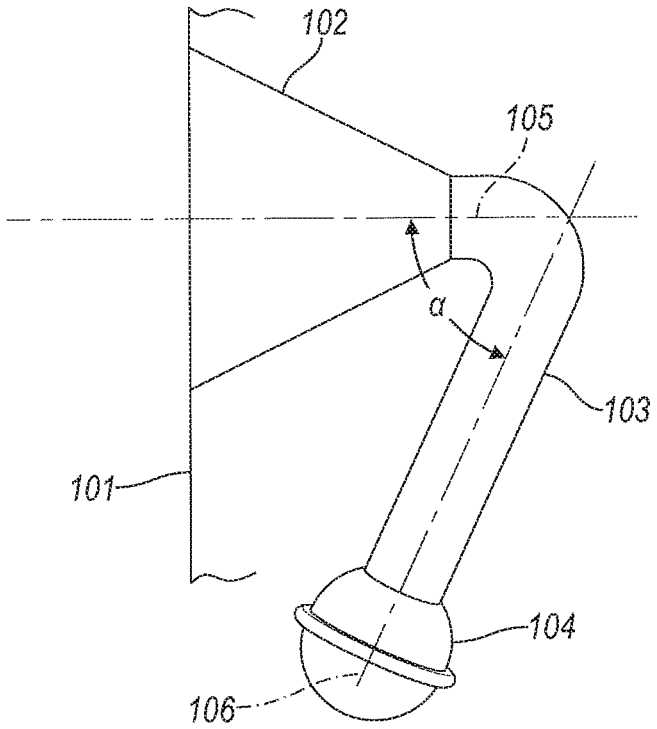
FIG. 2A is a side view of the acoustic assembly of FIG. 1.

As shown in FIG. 2A, when viewing the acoustic assembly 100 from a side view, the first axis 105 and the second axis 106 appear to have an intersection angle $\alpha$. The intersection angle $\alpha$ is greater than 0° and less than 180°.

The first axis 105 and the second axis 106 may actually intersect. Alternatively, from the side view, the first axis 105 and the second axis 106 may give the appearance of intersecting. The appearance may result from the first axis 105 lying on a first plane, and the second axis 106 lying on a second plane. In such cases, the side view depicts the intersection of the first plane and the second plane.

Figure 2B:
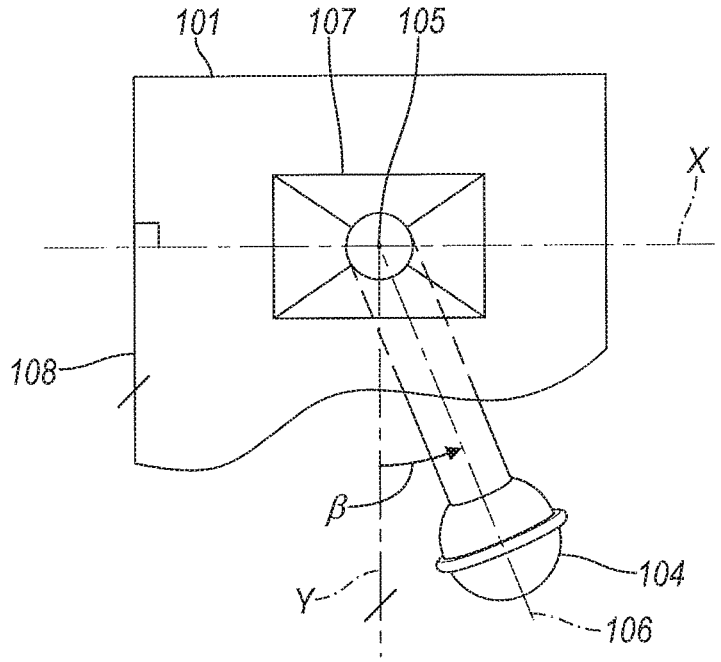
FIG. 2B is a front view of the acoustic assembly of FIG. 1.

As shown in FIG. 2B, when viewing the acoustic assembly 100 from a front view, the waveguide 102 includes a mouth 107. The mouth 107 may be rectangular, ellipsoidal, or a number of different shapes. In the front view, a first imaginary line X passes through the first axis 105 and the mouth 107. A second imaginary line Y passes through the first axis 105 and the mouth 107. The first imaginary line X and the second imaginary line Y are oriented 90° to one another.

The first imaginary line X is perpendicular to an edge 108 of the first surface 101. And therefore, the second imaginary line Y is parallel to the edge 108. From the front view, the second axis 106 may appear to or actually align on the second imaginary line Y. As an alternative, the second axis 106 may appear to or actually intersect through the second imaginary line Y at a rotational angle $\beta$. In such case, the rotational angle $\beta$ is greater than 0° and less than 360°.

The intersection angle $\alpha$ and the rotational angle $\beta$ may be set during installation of the acoustic assembly 100 to the first surface 101. Alternatively, the intersection angle $\alpha$ and the rotational angle $\beta$ may be selected well in advance of installation, such as during design of the acoustic assembly 100. The intersection angle $\alpha$ and the rotational angle $\beta$ provide more options during design and installation of the acoustic assembly 100. For example, if physical obstacles are encountered during installation or need to be considered in advance of installation, the intersection angle $\alpha$ and the rotational angle $\beta$ may be adjusted accordingly. Additionally, dimensioning of the other components in the acoustic assembly 100, such as the tube 103, may be adjusted to overcome physical obstacles. Some examples of physical objects include piping, ducting, electrical wiring, supports, such as trusses, beams, columns, etc.

Figure 3:
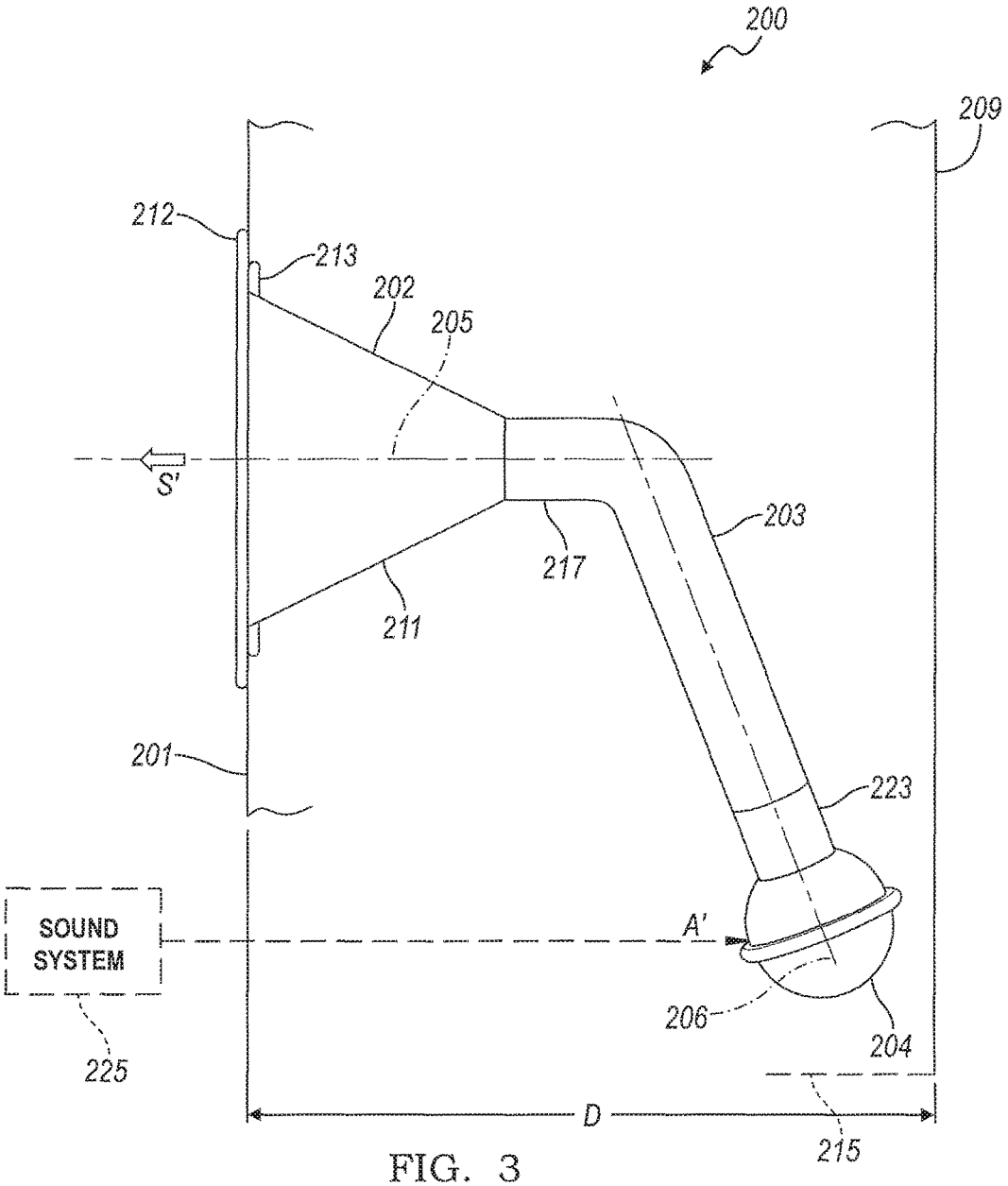
FIG. 3 is a schematic diagram of an acoustic assembly and a sound system, which collectively are an acoustic system and are in accordance with one or more embodiments.
Figure 4:
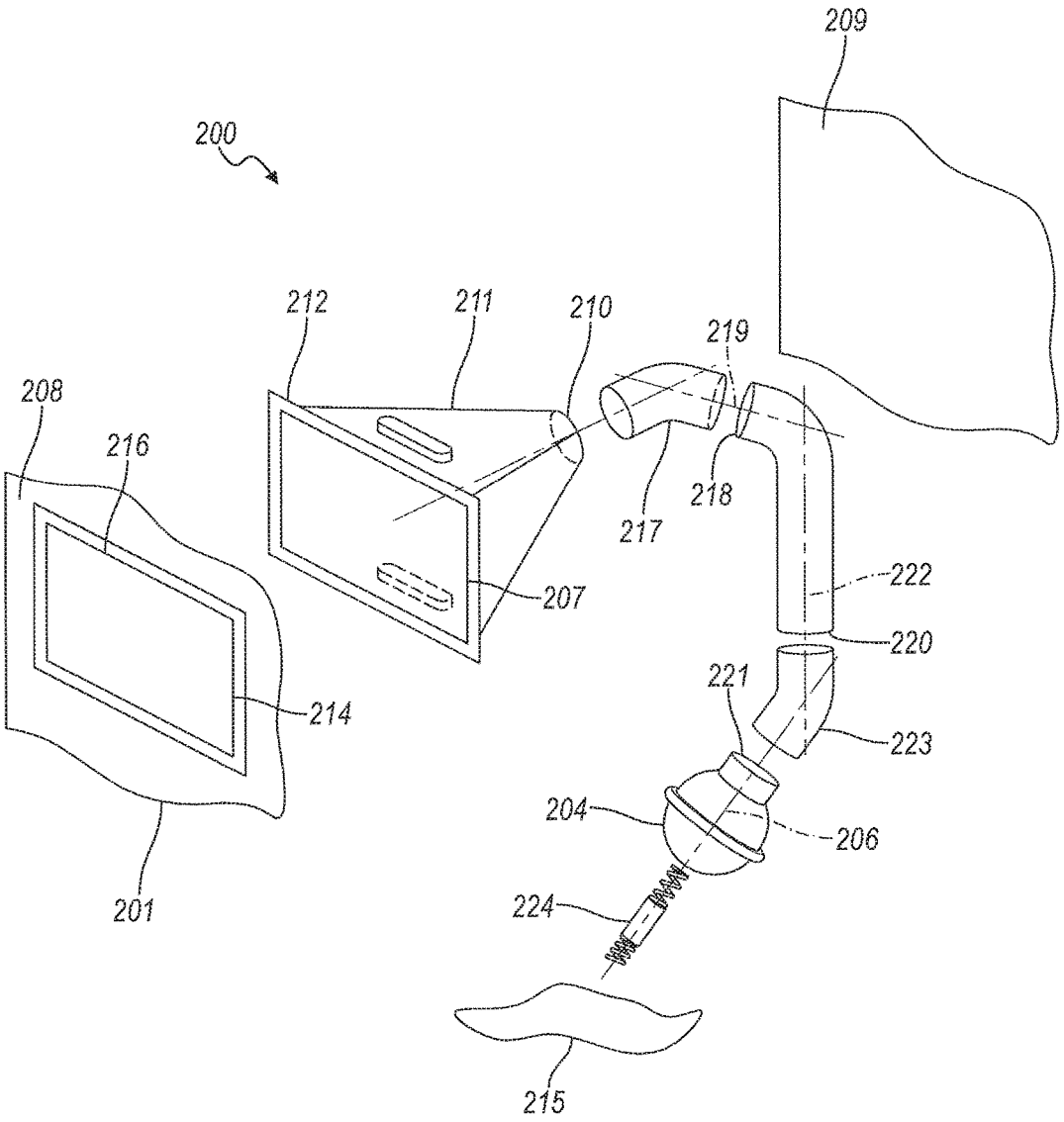
FIG. 4 is an exploded view of the acoustic assembly of FIG. 3.

In accordance with one or more embodiments, FIG. 3 illustrates a schematic diagram of an acoustic assembly 200 in an angled orientation and used in a shallow-depth environment. The shallow-depth environment may form a structural part of a listening room, such as an in-wall application, an in-door application, an in-ceiling application, etc. The listening room may be a vehicle cabin, a recording studio, a concert hall, a room in a home, etc. Alternatively, the shallow-depth environment may be a portable device, such as an audio cabinet enclosure.

The shallow-depth environment includes a first surface 201. The acoustic assembly 200 includes a waveguide 202 that either mounts to the first surface 201 or is formed with the first surface 201. The waveguide 202 removably attaches to a tube 203. And the tube 203 removably attaches to a compression driver 204. In the angled orientation, the waveguide 202 aligns along a first axis 205. And the compression driver 204 aligns along a second axis 206. The waveguide 202 includes a mouth 207. And the first surface 201 may include an edge 208.

In the shallow-depth environment, a shallow distance D separates the first surface 201 from a second surface 209. The shallow distance D may be at or under 12 inches. The angled orientation (i.e., the waveguide 202 being aligned on the first axis 205, and the compression driver 204 being aligned on the second axis 206) allows for more options in designing the acoustic assembly 200. That is primarily because increasing the sizing or bettering the performance of the waveguide 202 does not necessarily result in reducing the sizing or lessening the performance of the compression driver 204.

Those additional options, however, do not appear in designing a conventionally arranged acoustic assembly for a shallow-depth environment. In the conventionally arranged acoustic assembly—i.e., where a waveguide and a compression driver align along a single, common axis—there are far fewer design options. That is primarily because the single, common axis requires the dimensional constraint of the shallow environment to be the critical focus, as opposed to acoustics. Because of that, the conventionally arranged acoustic assembly routinely requires acoustical sacrifices and compromises. Such acoustical sacrifices and compromises lead to a poor acoustical match between the waveguide and the compression driver, having to select an underpowered, overly limited in range compression driver, having to select a less-than-desirable coverage pattern for the waveguide, etc. Because of that, the sound quality of the conventionally arranged acoustic assembly in the shallow-depth environment is poor.

In the angled orientation, however, the critical focus in designing the acoustic assembly 200 is acoustics. Because of that, the waveguide 202, the tube 203, and the compression driver 204 can be designed to achieve a desirable acoustical match. The desirable acoustical match thus results in the acoustic assembly 200 at least producing desirable sound quality.

In the acoustic assembly, the waveguide 202 includes a throat 210 that is distal to the mouth 207. The throat 210 may have the same shape as the mouth 207. Alternatively, the throat 210 may have a different shape from the mouth 207. Between the throat 210 and the mouth 207, the waveguide 202 includes a transitional surface 211. In the waveguide 202, at least the throat 210 aligns along the first axis 205.

The waveguide 202 may be manufactured under a variety of techniques, such as injection molding. And the waveguide 202 may be made out of a hard, rigid polymer or other materials known in the art, such as various metals. Manufacturing the waveguide 202 out of the hard, rigid polymer is generally more economical, efficient, and affordable than processes involving metals. Additionally, the hard, rigid polymer in the waveguide 202 generally performs acoustically as well as a metal version—if not better. Moreover, because the hard, rigid polymer will generally weigh less than one made out of a metal, the lower weight may be particularly beneficial for shipping and installing the waveguide 202.

In the shallow-depth environment, where the waveguide 202 and the first surface 201 are modular, the waveguide 202 includes either a lip 212 about the mouth 207, a projection 213 at least partly about the transitional surface 211, or a combination thereof. The lip 212 and the projection 213 may be integrally attached to the waveguide 202 or may be attachable to the waveguide 202. The first surface 201 includes an opening 214 for receiving the acoustic assembly 200. When in the opening 214, the lip 212 and/or projection 213 may be used to mount the waveguide 202 to the first surface 201. Adhesives, fasteners, other hardware, or other ways known in the art may be used to further secure the waveguide 202 to the first surface 201.

Additionally, one or more vibration-sound absorption pads may be used to prevent the waveguide 202 from rattling in the opening 214. Such vibration-sound absorption pads may be used in other areas of the acoustic assembly 200—e.g., an area on the compression driver 204 that may otherwise contact the first surface 201 or the second surface 209. The vibration-sound pads may include a material that is prone to absorbing, but not transmitting vibrations and sound, such as a synthetic rubber. In addition to or in the alternative, the vibration-sound absorption pads may include a spring to counteract movement by the acoustic assembly 200. As an example, the vibration-sound absorption pad may be a soft gasket that is placed around the periphery of the waveguide 202 and is compressed between the lip 212 of the waveguide 202 and the first surface 201.

When placed in the opening 214, the weight of the acoustic assembly 200 may draw the lip 212 against the outer side of the first surface 201. The drawing may particularly occur when the acoustic assembly 200 is in a suspended position. In the suspended position, the compression driver 204 hangs above a lower member 215 (such as a floor for the first surface 201 and the second surface 209), as opposed to resting on top of the lower member 215. While in the suspended position, the weight acting at the center of gravity of the acoustic assembly may cause the drawing of the waveguide 202 against the first surface 201. Therefore, during the design of the acoustic assembly 200, for drawing purposes, factors that influence the location of the center of gravity may be taken into account. Such factors may include material selection, dimensioning, angular orientations, etc. As an example, the center of gravity of the acoustic assembly 200 may be located closer to the compression driver 204 than the waveguide 202.

When in the opening 214, the lip 212 may be flush or nearly flush with the first surface 201. Moreover, the first surface 201 may include a recess 216 about the opening 214 on the outer side. The depth of the recess 216 is such that when the recess receives the lip 212, the lip 212 is flush or nearly flush with the first surface 201.

As an addition or an alternative, the projection 213 may mate against an inner side of the first surface 201. The inner side of the first surface 201 faces an inner side of the second surface 209. Mating against the inner side of the first surface 201 may be desirable when the first surface 201 is a ceiling. In the ceiling example, the weight of the acoustic assembly 200 would press the projection 213 against the inner side of the first surface 201. While the ceiling example is desirable, the inner lip may mate against the inner side in other examples.

To mate against the inner side of the first surface 201, the projection 213 may be flexible or retractable. In the flexible example, when the waveguide 202 is placed through the opening 214, the projection 213 transitions from a default state, to a temporarily deformed state, and back to the default state. The transition occurs because the size of the opening 214 is smaller than the perimeter of the waveguide 202 about the projection 213. Once the projection 213 is past the inner side of the first surface 201, the projection 213 elastically returns to the default state.

In the retractable example, the projection 213 transitions from a retracted state to a deployed state. In the retracted state, the projection 213 may be flush or nearly flush with the exterior of the transitional surface 211. In the retracted state, the size of the opening 214 is larger than the size of the waveguide 202 about the retracted projection 213. That allows the waveguide 202 to be placed in the opening 214. Once in the opening 214, the projection 213 transitions from the retracted state to the deployed state. A simple screw mechanism or other means know in the art allows the projection to transition between the retracted state and the deployed state.

At the throat 210, the waveguide 202 removably attaches to the tube 203. The removable attachment between the waveguide 202 and the tube 203 may be direct or through a first coupling 217. In the direct attachment, a first end 218 of the tube 203 attaches over the throat 210. Through a threaded relationship, the first end 218 may screw onto the throat 210. Alternatively, clamps or other ways known in the art may be used to directly attach the waveguide 202 to the tube 203.

As an alternative, the first coupling 217 may receive the throat 210 of the waveguide 202 and the first end 218 of the tube 203. Through threaded relationships, the throat 210 may screw into the first coupling 217, and the first end 218 may screw into the first coupling 217. Alternatively, clamps or other ways known in the art may be used to attach the first coupling 217 to the waveguide 202 and the tube 203.

The first coupling 217 may be made out of a rigid material or a flexible material. Between the two types of materials, the flexible material may allow for easier installation of the acoustic assembly in the shallow-depth environment. That is because the flexible material may include at least one more degree of freedom than the rigid material. That is particularly desirable if there is a physical obstacle in the shallow-depth environment. As an alternative, the first coupling may be such that it transitions from flexible to rigid over time—e.g., such as via a fiberglassing technique, which involves applying a resin and/or a hardener to a flexible fiberglass mat to cause the fiberglass mat to become rigid.

The first end 218 of the tube 203 may align along the first axis 205. Alternatively, the first end 218 may align along a third axis 219. The tube 203 may have a constant cross-sectional profile throughout. The cross-sectional profile may be circular, ellipsoidal, rectangular, or a number of different shapes. Like the first coupling 217, the tube 203 may be made out a rigid material, a flexible material, or a material that transitions from flexible to rigid.

The tube 203 includes a second end 220 that removably attaches to the compression driver 204. For removably attaching to the tube 203, the compression driver 204 includes an output opening 221. The output opening 221 aligns along the second axis 206. The second end 220 of the tube 203 may also align along the second axis 206. Alternatively, the second end 220 may align along a fourth axis 222.

The removable attachment between the tube 203 and the compression driver may be direct or through a second coupling 223. Through a threaded relationship, the second end 220 may screw onto the output opening 221. Alternatively, clamps or other ways known in the art may be used to directly attach the tube 203 to the compression driver 204.

As an alternative, the second coupling 223 may receive the second end 220 of the tube 203 and the output opening 221 of the compression driver 204. Through threaded relationships, the second end 220 and the output opening 221 may screw into the second coupling 223. Alternatively, clamps or other ways known in the art may be used to attach the second coupling 223 to the tube 203 and the compression driver 204. Like the first coupling 217, the second coupling 223 may be made out of a rigid material, a flexible material, or a material that transitions from flexible to rigid.

Like the tube 203, the first coupling 217 and the second coupling 223 may have constant cross-sectional profiles. Additionally, the inner surface of the tube 203, the first coupling 217, and the 223 second coupling may be smooth.

To prevent the acoustic assembly 200 from moving during operation in the shallow-depth environment, a vibration-sound absorption anchor 224 may be used. The vibration-sound absorption anchor 224 may attach to the compression driver 204, the tube 203, or elsewhere on the acoustic assembly 200. Additionally, the vibration-sound absorption anchor 224 may attach to the shallow-depth environment, such as the lower member 215. The vibration-sound absorption anchor 224 may include a material that is prone to absorbing, but not transmitting vibrations and sound, such as a synthetic rubber. In addition to or in the alternative, the vibration-sound absorption anchor 224 may include a spring to counteract movement by the acoustic assembly 200. The anchor 224 should therefore absorb vibrations and movements of the acoustic assembly. Doing so, should prevent the shallow-depth environment from producing unwanted noise.

For operation, the acoustic assembly 200 communicates with a sound system 225. During operation, the sound system 225 sends an audio signal A' to the compression driver 204. In response to the audio signal A', the compression driver 204 generates a sound wave S'. The sound wave S' travels from the compression driver 204, through the tube 203, and out of the waveguide 202.

Figure 5A:
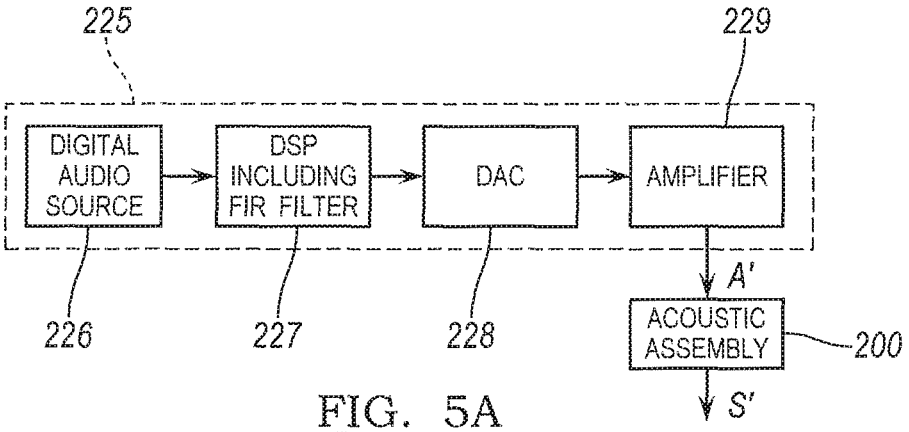
FIGS. 5A and 5B are schematic diagrams illustrating operation of the acoustic system of FIG. 3.

FIG. 5A is a schematic diagram illustrating an example of operation of the sound system 225 and the acoustic assembly 200. In the example, a digital audio source 226 is utilized. The digital audio source 226 may correspond to an MP3 device, a personal computer, a smartphone, a DVD player, a CD player, etc. The digital audio source 226 contains files that are in a digital format, such as MP3, WAV, etc. During operation, the digital audio source sends a digital signal to a digital signal processor (DSP) 227. The DSP 227 includes a finite impulse response (FIR) filter. In addition to the FIR filter, the DSP or elsewhere in the sound system 225 may include additional filters. The FIR filter filters the digital signal to account for an impulse response of the acoustic assembly 200. From there, the filtered digital signal is sent to a digital to analog converter (DAC) 228. The DAC 228 converts the filtered digital signal into an analog signal. The analog signal is then sent to an amplifier 229. And the amplifier 229 amplifies the analog signal. In the example, the amplified analog signal is the audio signal A'. The audio signal A' then drives the compression driver 204, which generates the sound wave S'. While the sound system 225 may include one or more wireless connections, such as between the digital audio source 226 and the DSP 227, the DSP 227 and the DAC 228, etc., the connection between the amplifier 229 and the compression driver 204 is a wired connection. Alternatively, all of the connections in the sound system 225 may be wired connections.

Figure 5B:
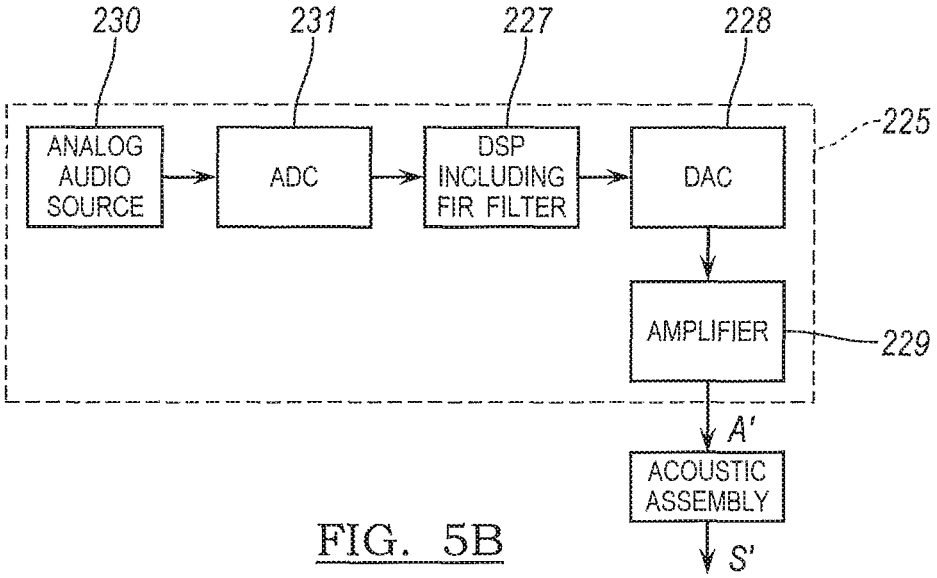

FIG. 5B is a schematic diagram illustrating another example of operation of the sound system 225 and the acoustic assembly 200. In the example, an analog audio source 230 is utilized. The analog audio source 230 may correspond to a microphone, a musical instrument (such as a guitar), a record player, etc. The analog audio source 230 sends a first analog signal to an analog to digital converter (ADC) 231. The ADC 231 converts the first analog signal to a digital signal. From there, the digital signal is sent to the DSP 227. As stated before, the DSP 227 includes the FIR filter. And like FIG. 5A, the FIR filter filters the digital signal to account for the impulse response of the acoustic assembly 200. From there, the filtered digital signal is sent to a DAC 228. The DAC 228 converts the filtered digital signal into a second analog signal. The second analog signal is then sent to an amplifier 229. And the amplifier 229 amplifies the second analog signal. In the example, the amplified second analog signal is the audio signal A'. The audio signal A' then drives the compression driver 204, which generates the sound wave S'. As in FIG. 5A, while the sound system 225 may include one or more wireless connections (which may be carried out by one or more transmitters, receivers, and/or transceivers), the connection between the amplifier 229 and the compression driver 204 is a wired connection.

As mentioned in relation to FIGS. 5A and 5B, the sound system 225 includes the FIR filter. And the FIR filter is meant to account for the impulse response of the acoustic assembly 200. The impulse response of the acoustic assembly 200 can be found by performing an impulse response test. Through the impulse response test, the FIR filter's length may be set to account for the impulse response of the acoustic assembly 200. After setting the FIR filter's length, the acoustic assembly 200 should achieve a more desirable sound quality. This is because the addition of the FIR filter should improve the acoustical performance of the acoustic assembly 200.

Figure 6:
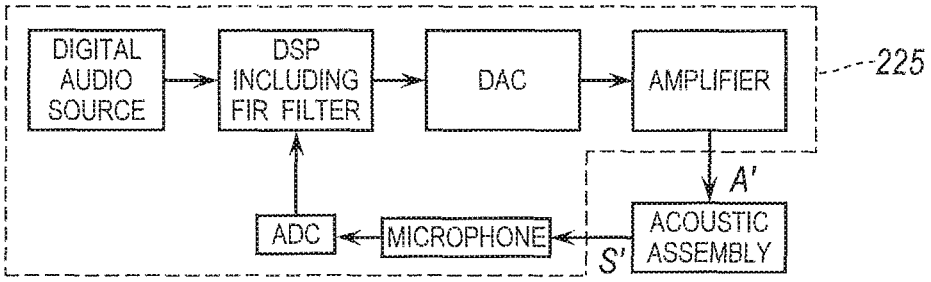
FIG. 6 is a schematic diagram illustrating operation of the acoustic system of FIG. 3 during an impulse response test.

FIG. 6 is a schematic diagram illustrating an example of operation of the sound system 225 and the acoustic assembly 200 during the impulse response test. In the example, the digital audio source 226 sends a test digital signal to the DSP. In the DSP, initially for the test, either the FIR filter is bypassed or the FIR filter is set to a default length (such that the filtered test digital signal leaving the FIR filter is equal to the unfiltered digital test signal that enters the FIR filter). In either case, the test digital signal that enters the DSP may be identical to the test digital signal that leaves the DSP. From the DSP, the test digital signal is sent to the DAC. The DAC converts the test digital signal to a test analog signal. The test analog signal is then sent to the amplifier, which amplifies the test analog signal. The amplified test analog signal is the audio signal A'. The audio signal A' then drives the compression driver 204, which generates sound wave S'. The sound wave S' travels through the acoustic assembly 200. While traveling, the sound wave S' may reflect within the acoustic assembly 200. Those reflections may cause unwanted acoustical effects, such as unintended echoes. The reflections and the way that the sound wave S' otherwise travels through the acoustic assembly equates to the impulse response of the acoustic assembly 200.

During the test, a microphone detects the impulse response of the acoustic assembly 200. The microphone sends the impulse response to the ADC. The ADC converts the impulse response to a digital impulse response. The digital impulse response is then sent to the DSP for processing. As part of the processing, the DSP may automatically set the FIR filter's length to account for the impulse response of the acoustic assembly 200. Alternatively, as part of the processing, the DSP may generate a plot (such as a decibel over time plot) or other visual data off of the digital impulse response. In doing so, the plot shows the impulse response of the acoustic assembly 200, which may occur via a display (not shown). A user of the acoustic assembly 200 and the sound system 225 (such as a laboratory technician/tester, installer, end-user, manufacturer, etc.) may use the plot or other data to set the FIR filter's length. As part of the plot or other data, the DSP may propose a length for the FIR filter to the user.

The impulse response, which may be shown in the plot, includes a direct portion. The direct portion corresponds to the time that compression driver generates the sound wave S', which is in response to the audio signal A'. During the direct portion, the sound wave S' achieves its maximum dBs. Following the direct portion is a tail portion. The tail portion generally occurs after the generation of the sound wave S' and post completion of the audio signal A' driving the compression driver 204. In general, the tail portion indicates a decay of the sound wave S', such that the sound wave S' appears to be (or may actually be) decaying to 0 dB. Following the tail portion, the impulse response may also include one or more major reflections. In general, a major reflection appears as a resurgent, temporary spike-like portion on the plot. Therefore, on the plot, as opposed to having a smooth decay to 0 dB from the tail portion onward, a major reflection includes a temporary resurgence in dB post tail portion.

From the impulse response, the FIR filter's length may be set to cover at least the first major reflection. In an ideal case involving N number of major reflections, where N is a real, whole number greater than zero, the FIR filter's length may be set to cover the N major reflections (i.e., from the first major reflection through the last major reflection). For example, if there are two major reflections, then the FIR filter's length may be set to cover from the start of the first major reflection through the end of the second major reflection.

In setting the FIR filter's length to cover N major reflections, the N major reflections may sum to 0 dB. This is because setting the FIR filter's length to that effect should result in an inverse, cancelling wave being applied to the N major reflections. The inverse, cancelling wave may be applied by the FIR filter. And summing the inverse, cancelling wave with N major reflections should result in 0 dB. Doing so effectively creates a flat response for the post-tail portion. The flat response via the FIR filter should achieve a more desirable sound quality. That is because the flat response essentially eliminates unwanted acoustical effects that would have otherwise been created by the major reflections.

In addition to covering the at least first major reflection, the FIR filter's length may be set to cover part or all of the tail portion. For example, if the length of the tail portion is negatively impacting sound quality, then the FIR filter's length may be adjusted to cover part of the tail portion. Doing so would result in an inverse, cancelling wave being applied to part of the tail portion, as well the first major reflection. That should at least result in the part of the tail portion and the first major reflection summing to 0 dB. One potential reason for covering at least a part of the tail portion may be to further eliminate the acoustic assembly 200 from adding any acoustical effects, such as an unintended echo, to the sound wave S'. Through such elimination, a listener may hear a true representation of the audio signal A' via the sound wave S', as opposed to a version heavily influenced by the acoustical assembly 200.

The impulse response test may be conducted by the manufacturer, such as within a manufacturer's anechoic chamber or other testing facility. Alternatively, the impulse response test may occur after assembling the acoustic assembly 200 (and/or installation of the acoustic assembly into the shallow-depth environment), such as by an installer, end-user/customer, etc.

Figure 7:
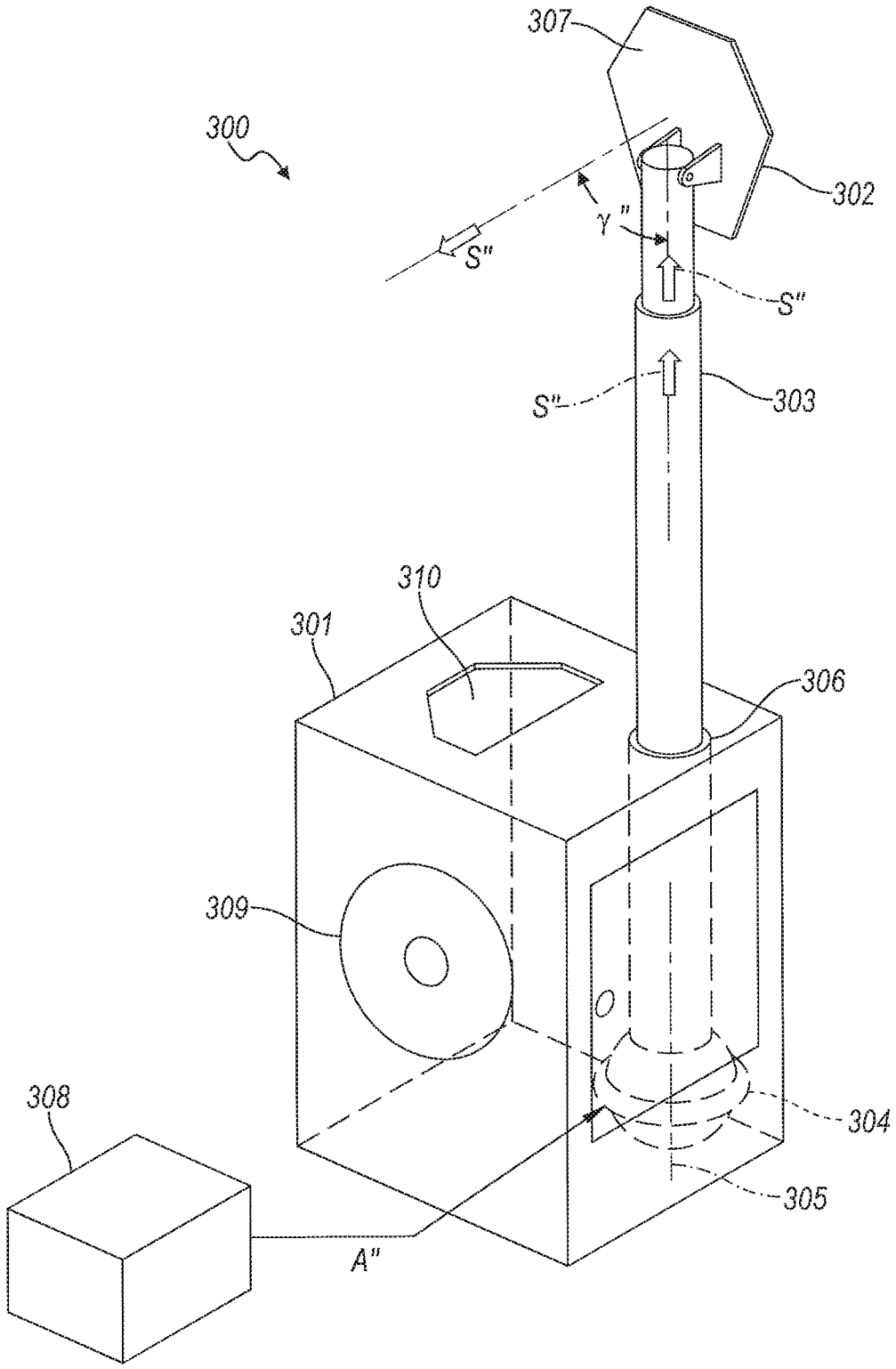
FIG. 7 is a front perspective view of an acoustic assembly, which is in accordance with one or more embodiments.

In accordance with one or more embodiments, FIG. 7 illustrates a perspective view of an acoustic assembly 300 in a portable enclosure 301. The acoustic assembly 300 in connection with the enclosure 301 is in a deployed position. The enclosure 301 may be formed of modular components or may be made of a unitary component, such as via an injection molding process. The enclosure 301 defines a cavity for housing the acoustic assembly 300. The enclosure 301 may include an access panel for accessing the cavity.

The acoustic assembly 300 includes a deflector 302. The deflector 302 acts like a waveguide, but has a different constructional arrangement. Unlike a waveguide where a sound wave travels internally from a throat to a mouth, a sound wave deflects off of the deflector 302. While the deflector is shown in 302, a waveguide could be used in place of the deflector 302. The deflector 302 either removably attaches or permanently attaches to a tube 303. The attachment between the deflector 302 and the tube 303 may occur via a hinge, a collar, or other ways known in the art. The tube 303 either removably attaches or permanently attaches to a compression driver 304. The compression driver 304 is securely mounted within the enclosure 301.

The tube 303 and the compression driver 304 align along an axis 305. The tube 303 may be a fixed length or may be extendable and retractable along the axis 305. As an example of extendable/retractable, the tube 303 may be telescoping. As another example, the tube 303 may include a number of removably attachable tube segments (where all of the tube segments may be used at one time or a smaller number than all may be used).

Compared to the fixed length, having the tube 303 extendable/retractable along the axis 305 provides more options for coverage pattern. That is because the length of the tube 303 influences coverage pattern of the acoustic assembly 300. Therefore, having the ability to adjust the length of the tube 303 provides for more options in setting the coverage pattern of the acoustic assembly 300. When the tube 303 is extendable/retractable, the length of the tube may be releasably set and secured to a desired distance by hardware or other ways known in the art, such as a twist-lock. Until released, the tube 303 stays at the desired distance. The setting, securing, and releasing may be physically performed by a user or through an electric motor and a controller. In addition to setting coverage pattern, the tube 303 may be retracted and releasably set and secured to a travel position. The travel position allows for easy transportation of the acoustic assembly 300 and the enclosure 301. In the travel position, the entire tube may reside within the enclosure 301. Additionally, in connection with the travel position, the enclosure 301 may include a recess 310 for receiving the deflector 302. Alternatively, for travel purposes, the deflector may otherwise rest against the enclosure 301 or may be stored in the cavity of the enclosure 301, such as by way of the access panel.

The tube 303 may extend through an opening 306 in the enclosure 301. The opening 306 may directly contact the tube 303. Alternatively, a vibration-sound absorption pad may be used as an intermediary between the opening 306 and the tube 303.

In relation to the tube 303, the deflector 302 may be in a fixed position or may be adjusted to a desired position. As an example of adjusting for the desired position, the deflector 302 may rotate about the axis 305. That rotation may occur independent of the tube 303. Alternatively, the tube 303 may rotate about the axis 305—such that the deflector 302 also rotates about the axis 305. Additionally, the deflector 302 may otherwise move in relation to the tube 303. Adjusting the deflector 302 may occur via hardware or other ways known in the art, such as a hinge, swivel, or ratchet mechanism. And once adjusted to the desired position, the deflector 302 may be releasably set and secured such that it stays in the desired position by hardware or other ways known in the art, such as a locking mechanism. Adjusting the deflector 302 may be physically performed by a user or through an electric motor and a controller.

Compared to the fixed position, having the deflector 302 adjustable in relation to the tube 303 provides more options for coverage pattern. That is because the orientation of the deflector 302 affects coverage pattern of the acoustic assembly 300. Therefore, having the ability to adjust the orientation of the deflector 302 provides for more options in setting the coverage pattern of the acoustic assembly 300.

In addition to orientation, the shape of the deflector 302 impacts coverage pattern. Because of that, the deflector 302 may be spherical, conical, cylindrical, ellipsoidal, triangular, rectangular, pentagonal, hexagonal, pyramidal, etc. Additionally, the deflector 302 may be a partial section of any of the aforementioned shapes, such as three-sides of a rectangular prism. Furthermore, the surface 307 of the deflector 302 impacts coverage pattern. The surface 307 may be flat and smooth, curved and smooth, patterned or randomly covered with projections and/or depressions, etc.

During operation of the acoustic assembly 300, a sound system 308 communicates with the compression driver 304. The sound system may be external to the enclosure 301 or within the enclosure 301. During operation, the sound system 308 sends an audio signal A" to the compression driver 304. In response to the audio signal A", the compression driver generates a sound wave S". From the compression driver 304, the sound wave S" generally travels in a first direction within the tube 303. The first direction is along or parallel to the axis 305. After leaving the tube 303, the sound wave S" deflects off of the surface 307 of the deflector 302. In doing so, the sound wave S" changes direction from the first direction to a second direction. Relative to the first direction, the second direction may be at a deflection angle $\gamma$ that is greater than 0° and less than 180°. That change in direction corresponds to the coverage pattern for the acoustic assembly 300.

While traveling through the tube 303, the sound wave S" may reflect. Any reflections, as well as the way the sound wave S" otherwise travels through the tube 303, can be found through an impulse response test. Based on the results of the impulse response test (i.e., the impulse response of the acoustic assembly 300), the acoustical performance of the acoustic assembly may be improved. For example, when the sound system 308 includes, among other things, an FIR filter, the FIR filter's length may be set to account for the results of the impulse response test.

In addition to the acoustic assembly 300, the enclosure 301 may include one or more loudspeakers 309. In setting the coverage pattern of the acoustic assembly 300, the acoustical performance and orientation of the loudspeaker(s) 309 may be considered. Doing so may create a more immersive and acoustically pleasing experience for a user, such as by promoting blending of the sound wave S" with the output of the loudspeaker(s) 309, as opposed to source separation. The loudspeaker(s) 309 may generally be of a lower frequency range than the acoustic assembly 300. For example, the loudspeakers 309 may cover low frequencies and/or middle frequencies, whereas the acoustic assembly 300 may cover high frequencies. Furthermore, the enclosure 301 may include additional acoustic assemblies, beyond acoustic assembly 300. Moreover, the sound system 308 may also be used to send audio signals to the loudspeaker(s) 309 and any additional acoustic assemblies. And even further yet, the enclosure 301 and the acoustic assembly 300 may be used with other audio products, such as additional enclosures containing compression drivers and/or loudspeakers. The sound system 308 may also be used to send audio signals to those additional enclosures and the compression drivers and/or loudspeakers therein. And even further yet, the sound system 308 may be powered by any source known in the art, such as a DC battery, AC grid, etc.

Figure 8:
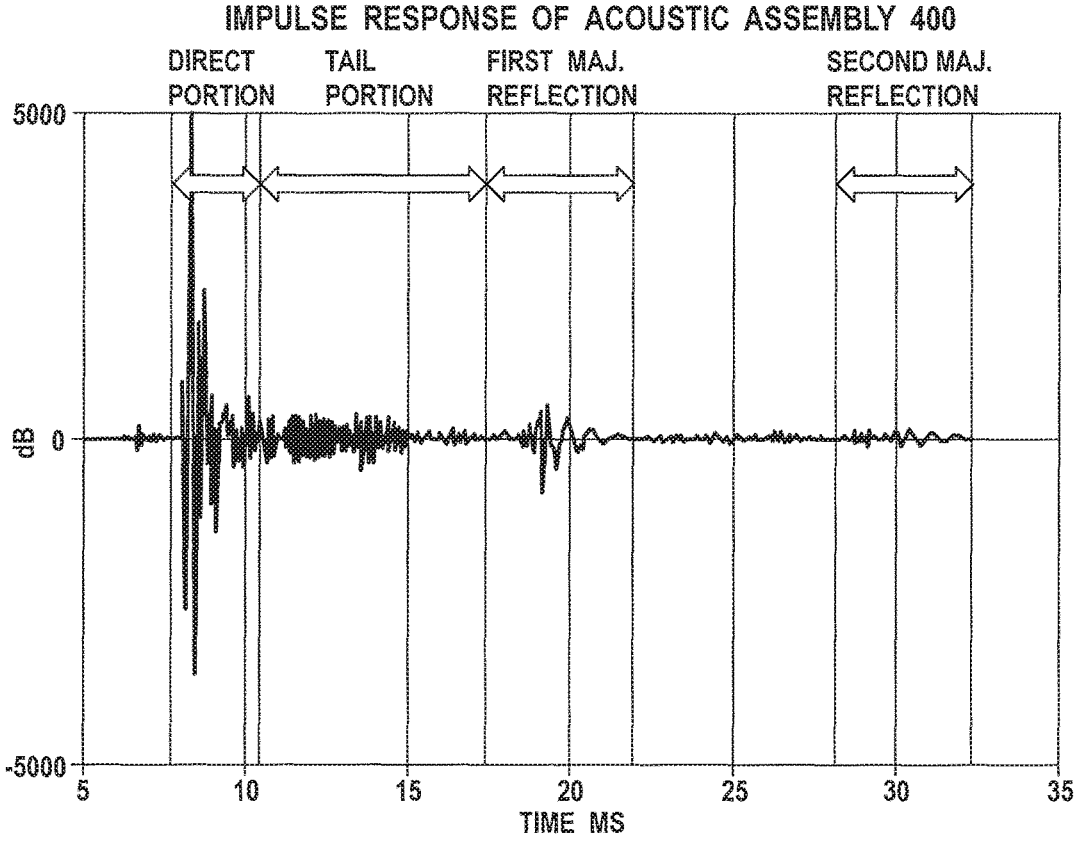
FIG. 8 is an example of an impulse response for an acoustic assembly, which is at least based on the acoustic assembly of FIG. 7.

FIG. 8 illustrates an example of an impulse response for an acoustic assembly 400, which is at least in accordance with the acoustic assembly 300. The impulse response for the acoustic assembly 400 was determined through an impulse response test. Based on the impulse response test, the acoustic assembly's impulse response includes a direct portion between seven and eleven milliseconds. Following the direct portion, the acoustic assembly 400 includes a tail portion between eleven and seventeen milliseconds. And following the tail portion, the acoustic assembly 400 includes a first major reflection between seventeen and twenty-two milliseconds and a second major reflection between twenty-seven and thirty-two milliseconds.

As an example, a sound system including an FIR filter may set the FIR filter's length to at least cover the first major reflection (i.e., between seventeen and twenty-two milliseconds). In another example, the FIR filter's length may be set to at least cover the first major reflection and the second major reflection. And in another example, the FIR filter's length may be set to at least cover the tail portion and the first major reflection. And in another example, the FIR filter's length may be set to cover the tail portion through the second major reflection. Alternatively, the FIR filter's length may be otherwise set.

Figure 9:
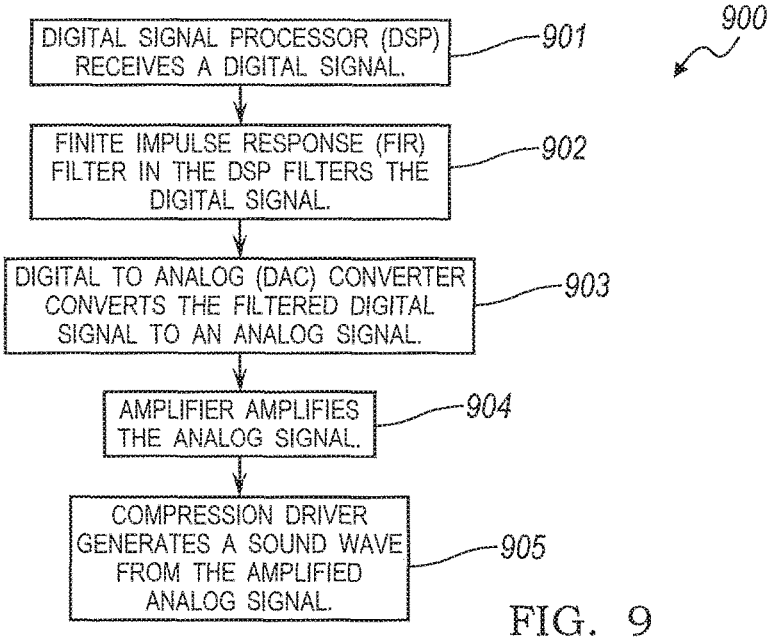
FIG. 9 is a flowchart depicting operation of an acoustic system, which is in accordance with one or more embodiments.

In accordance with one or more embodiments, FIG. 9 is a flowchart depicting operation of an acoustic system 900. In a step 901 of operating the acoustic system 900, a DSP receives a digital signal. In another step 902, a FIR filter in the DSP filters the digital signal. In another step 903, a DAC converts the filtered digital signal to an analog signal. In another step 904, an amplifier amplifies the analog signal. And in another step 905, a compression driver generates a sound wave from the amplified analog signal. For operation, the acoustic system 900 may include additional steps, such as beyond steps 901 through 905.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An acoustic system comprising:

an acoustic assembly including:

a waveguide aligned along a first axis;

a tube removably attached to the waveguide; and a compression driver aligned along a second axis and removably attached to the tube; and a sound system configured to send an audio signal to the acoustic assembly for generating a sound wave, wherein the sound system includes a processor including a finite impulse response (FIR) filter, wherein the FIR filter includes a filter length based on an impulse response of the acoustic assembly for canceling out one or more major reflections occurring within the acoustic assembly.

2. The acoustic system of claim 1, wherein the impulse response of the acoustic assembly includes a direct portion, a tail portion, and the one or more major reflections, wherein the filter length is configured to at least cover a first major reflection of the one or more major reflections such that the FIR filter at least cancels out the first major reflection, wherein the first major reflection occurs within the tube of the acoustic assembly.

3. The acoustic system of claim 1, wherein the sound system sends the audio signal, which has been filtered by the FIR filter, to the compression driver, and in response to the audio signal, the compression driver generates the sound wave to travel through the acoustic assembly, wherein the sound wave travels out of the compression driver and into the tube in a first direction along the second axis.

4. The acoustic system of claim 3, wherein while the sound wave travels from the tube to the waveguide, the tube transitions the sound wave from traveling in the first direction to traveling in a second direction, wherein the second direction is along the first axis.

5. The acoustic system of claim 1, wherein the first axis and the second axis intersect at an intersection angle that is greater than 0° and less than 180°.

6. The acoustic system of claim 1, wherein the first axis lies on a first plane, and the second axis lies on a second plane, wherein the first plane and the second plane intersect at an intersection angle that is greater than 0° and less than 180°.

7. The acoustic system of claim 1, wherein the sound system includes a digital audio source configured to send a digital signal to the FIR filter, wherein the FIR filter is configured to filter the digital signal from the digital audio source to provide a filtered digital signal.

8. The acoustic system of claim 7, wherein the sound system includes a digital to analog converter (DAC) configured to convert the filtered digital signal from the FIR filter to an analog signal.

9. The acoustic system of claim 8, wherein the sound system includes an amplifier configured to amplify the analog signal from the DAC to provide an amplified analog signal.

10. The acoustic system of claim 9, wherein the amplifier is further configured to send the amplified analog signal as the audio signal to the acoustic assembly.

11. An acoustic system comprising:

an acoustic assembly including:

a waveguide having a throat aligned along a first axis;

a tube having a first end and a second end, wherein the first end is removably attached to the throat; and a compression driver having an output opening aligned along a second axis, wherein the second end of the tube is removably attached to the output opening; and a sound system configured to send an audio signal to the acoustic assembly for generating a sound wave, wherein the sound system includes a processor including a finite impulse response (FIR) filter, wherein the FIR filter includes a filter length based on an impulse response of the acoustic assembly to cancel one or more major reflections occurring within the acoustic assembly.

12. The acoustic system of claim 11, wherein the impulse response of the acoustic assembly includes a direct portion, a tail portion, and the one or more major reflections, wherein the filter length is configured to at least cover a first major reflection of the one or more major reflections such that the FIR filter at least cancels out the first major reflection, wherein the first major reflection occurs within the tube of the acoustic assembly.

13. The acoustic system of claim 11, wherein the sound system sends the audio signal, which has been filtered by the FIR filter, to the compression driver, and in response to the audio signal, the compression driver generates the sound wave to travel through the acoustic assembly, wherein the sound wave travels out of the compression driver and into the tube in a first direction along the second axis.

14. The acoustic system of claim 13, wherein while the sound wave travels from the tube to the waveguide, the tube transitions the sound wave from traveling in the first direction to traveling in a second direction, wherein the second direction is along the first axis.

15. The acoustic system of claim 11, wherein the first axis and the second axis intersect at an intersection angle that is greater than 0° and less than 180°.

16. The acoustic system of claim 11, wherein the first axis lies on a first plane and the second axis lies on a second plane, wherein the first plane and the second plane intersect at an intersection angle that is greater than 0° and less than 180°.

17. The acoustic system of claim 11, wherein the sound system includes a digital audio source configured to send a digital signal to the FIR filter, wherein the FIR filter is configured to filter the digital signal from the digital audio source to provide a filtered digital signal.

18. The acoustic system of claim 17, wherein the sound system includes a DAC and an amplifier, wherein the DAC is configured to convert the filtered digital signal from the FIR filter into an analog signal, and the amplifier is configured to amplify the analog signal from the DAC to provide an amplified analog signal, wherein the amplifier is further configured to send the amplified analog signal as the audio signal to the compression driver to generate the sound wave.

19. The acoustic system of claim 11, wherein the sound system includes an analog audio source configured to send an analog signal to an analog to digital converter (ADC), and the ADC is configured to convert the analog signal from the analog audio source to a digital signal, wherein the FIR filter is configured to filter the digital signal from the ADC to provide a filtered digital signal.

20. The acoustic system of claim 19, wherein the sound system includes a DAC and an amplifier, wherein the DAC is configured to convert the filtered digital signal from the FIR filter into an analog signal, wherein the amplifier is configured to amplify the analog signal from the DAC to provide an amplified analog signal, wherein the amplifier is further configured to send the amplified analog signal as the audio signal to the compression driver to generate the sound wave.

21. An acoustic system comprising:

an acoustic assembly including:

a deflector;

a tube removably attached to the deflector; and a compression driver removably attached to the tube, wherein the tube and the compression driver are aligned along a common axis; and a sound system configured to send an audio signal to the acoustic assembly for generating a sound wave, wherein the sound system includes a processor including a finite impulse response (FIR) filter, wherein the FIR filter includes a filter length based on an impulse response of the acoustic assembly for canceling out one or more major reflections occurring within the acoustic assembly.

22. The acoustic system of claim 21, wherein the impulse response of the acoustic assembly includes a direct portion, a tail portion, and the one or more major reflections, wherein the filter length is configured to at least cover a first major reflection of the one or more major reflections such that the FIR filter at least cancels out the first major reflection, wherein the first major reflection occurs within the tube of the acoustic assembly.

23. The acoustic system of claim 21, wherein the compression driver is configured to receive the audio signal and generate the sound wave, wherein the deflector is configured to transition the sound wave generated by the compression driver from traveling in a first direction along the common axis to traveling in a second direction, wherein relative to the first direction, the second direction is at a deflection angle that is greater than 0° and less than 180°.

24. A method for operating an acoustic system that includes a sound system in communication with an acoustic assembly, the method comprising the steps of:

in the sound system, sending a digital signal to a finite impulse response (FIR) filter;

filtering the digital signal in the FIR filter according to a filter length that is based on an impulse response of the acoustic assembly to provide a filtered digital signal, wherein the impulse response of the acoustic assembly includes a direct portion, a tail portion, and one or more major reflections occurring within the acoustic assembly, wherein the filter length is set to at least cover a first major reflection of the one or more major reflections occurring within the acoustic assembly such that the FIR filter at least cancels out the first major reflection;

converting the filtered digital signal to an analog signal in a DAC;

amplifying the analog signal in an amplifier to provide an amplified analog signal;

sending the amplified analog signal from the sound system to the acoustic assembly; and in the acoustic assembly, generating a sound wave in response to the amplified analog signal, and transitioning the sound wave from traveling in a first direction to traveling in a second direction.

25. The method of claim 24, wherein the sound wave is generated by a compression driver.

26. The method claim of 24, wherein the sound wave is transitioned from the first direction to the second direction by a tube having a first end and a second end, wherein the first end is aligned along a first axis, and the second end is aligned along a second axis, wherein the first direction runs along the second axis, and the second direction runs along the first axis, wherein the first axis and the second axis intersect at an intersection angle that is greater than 0° and less than 180°.

27. The method claim of 24, wherein the sound wave is transitioned from the first direction to the second direction by a deflector removably attached to a tube, wherein the tube is aligned along a common axis, wherein the first direction travels along the common axis, wherein relative to the first direction, the second direction is at a deflection angle that is greater than 0° and less than 180°.

* * * * *